US010557592B2

(12) United States Patent
Han et al.

(10) Patent No.: US 10,557,592 B2
(45) Date of Patent: Feb. 11, 2020

(54) CORNER STRUCTURE OF LNG STORAGE TANK

(71) Applicant: KC LNG Tech Co., Ltd., Busan (KR)

(72) Inventors: Hae Chul Han, Incheon (KR); Ihn Soo Yoon, Incheon (KR); Heung Seok Seo, Suwon-si (KR); Yong Bum Cho, Seoul (KR); Young Kyun Kim, Incheon (KR); Kyo Kook Jin, Incheon (KR); Yeong Beom Lee, Incheon (KR); Kun Hyung Choe, Seoul (KR)

(73) Assignee: KC LNG TECH CO., LTD., Busan (KR)

( * ) Notice: Subject to any disclaimer, the term of this patent is extended or adjusted under 35 U.S.C. 154(b) by 354 days.

(21) Appl. No.: 15/502,192

(22) PCT Filed: Aug. 6, 2015

(86) PCT No.: PCT/KR2015/008231
§ 371 (c)(1),
(2) Date: Feb. 6, 2017

(87) PCT Pub. No.: WO2016/021948
PCT Pub. Date: Feb. 11, 2016

(65) Prior Publication Data

US 2017/0227164 A1 Aug. 10, 2017

(30) Foreign Application Priority Data

Aug. 6, 2014 (KR) ..... 10-2014-0101189
Jan. 26, 2015 (KR) ..... 10-2015-0012010

(51) Int. Cl.
*B65D 6/00* (2006.01)
*F17C 3/02* (2006.01)
(Continued)

(52) U.S. Cl.
CPC ..... *F17C 3/025* (2013.01); *B63B 25/16* (2013.01); *F17C 3/04* (2013.01); *F17C 2203/03* (2013.01);
(Continued)

(58) Field of Classification Search
CPC .. F17C 3/025; F17C 3/027; F17C 3/04; F17C 2203/03; F17C 3/0358; F17C 3/0617;
(Continued)

(56) References Cited

U.S. PATENT DOCUMENTS 3,941,272 A 3/1976 McLaughlin
2008/0053993 A1* 3/2008 Yang ..... B63B 25/16 220/4.12

FOREIGN PATENT DOCUMENTS

JP 48-100716 A 12/1973
JP 55-140200 U 10/1980
(Continued)

OTHER PUBLICATIONS

International Search Report dated Nov. 16, 2015 of PCT/KR2015/008231 which is the parent application and its English translation—4 pages.
(Continued)

*Primary Examiner* — Andrew T Kirsch
*Assistant Examiner* — Elizabeth J Volz
(74) *Attorney, Agent, or Firm* — Knobbe, Martens, Olson & Bear LLP

(57) ABSTRACT

A corner structure comprises: a fixed member fixed to a corner of a storage tank; a movable member supported on the fixed member so as to be linearly movable; a stop member attached to the fixed member to prevent the movable member from being detached from the fixed member; and a heat insulating member disposed between a sealing wall and a hull. The fixed member comprises a guide portion
(Continued)

provided with a guide recessed portion, the movable member comprises a guide protruding portion inserted into the guide recessed portion, and the width and the length of the guide protruding portion are smaller than the width and the length of the guide recessed portion, so that the movable member can be supported on the fixed member to be movable in the longitudinal direction and in the direction perpendicular to the longitudinal direction.

15 Claims, 8 Drawing Sheets

(51) Int. Cl.
*B63B 25/16* (2006.01)
*F17C 3/04* (2006.01)

(52) U.S. Cl.
CPC ..... *F17C 2203/0639* (2013.01); *F17C 2221/033* (2013.01); *F17C 2223/0161* (2013.01); *F17C 2270/0105* (2013.01)

(58) Field of Classification Search
CPC .. F17C 3/0639; F17C 1/12; F17C 2201/0157; F17C 2201/052; F17C 2201/2221; F17C 2201/033; F17C 2223/0161; F17C 2223/033; F17C 2260/013; F17C 2270/0105; F17C 2270/0107; B63B 25/16
USPC ..... 220/560.11, 4.12, 560.07, 560.12; 114/74 A
See application file for complete search history.

(56) References Cited

FOREIGN PATENT DOCUMENTS

| | | | |
|---|---|---|---|
| JP | 2007-292282 | A | 11/2007 |
| JP | 4318934 | B2 | 8/2009 |
| JP | 4451439 | B2 | 4/2010 |
| JP | 4616279 | B2 | 1/2011 |
| JP | 4813934 | B2 | 11/2011 |
| KR | 10-0499710 | B1 | 7/2005 |
| KR | 10-2006-0109110 | A | 10/2006 |
| KR | 10-0649317 | B1 | 11/2006 |
| KR | 10-2012-0013258 | A | 2/2012 |
| KR | 10-1368763 | B1 | 3/2014 |

OTHER PUBLICATIONS

Notice of Allowance of corresponding Japanese Patent Application No. 2017-527524—3 pages (dated Jul. 2, 2018).
Office Action in corresponding Japanese Patent Application No. 2017-527524—3 pages, (dated Feb. 5, 2018).

* cited by examiner

Prior Art

CORNER STRUCTURE OF LNG STORAGE TANK

TECHNICAL FIELD

The present invention relates to a corner structure of an LNG storage tank, and, more particularly, to a corner structure arranged to provide a heat insulating wall and a sealing wall on an inner wall surface of an LNG storage tank for storing liquefied natural gas which has a liquid phase at ultra-low temperature.

BACKGROUND ART

Liquefied natural gas (LNG) is obtained by liquefying natural gas, one of the fossil fuels, and LNG storage tanks may be divided into onshore storage tanks installed on the ground or buried in the ground or mobile storage tanks installed in vehicles such as automobiles and ships, depending on installation location.

Since LNG has a danger of explosion when exposed to impact and is kept in a cryogenic state, a storage tank for LNG has a structure in which impact resistance and liquid tightness are maintained firmly.

In addition, in contrast to onshore storage tanks where sloshing of LNG is negligible, LNG storage tanks installed in automobiles and ships should be resistant to mechanical stress due to the sloshing. However, since LNG storage tanks installed on ships equipped with measures against mechanical stress can also be used as onshore storage tanks, the structure of an LNG storage tank installed on a ship will be described as an example herein.

FIG. 1 is a schematic sectional view of a ship equipped with a typical LNG storage tank.

Referring to FIG. 1, a ship equipped with an LNG storage tank generally has a double-hull structure including an outer wall 16 forming an outer shape and an inner wall 12 formed inside the outer wall 16. The inner wall 12 and the outer wall 16 of the ship 1 may be connected to each other through a reinforcing member such as a connecting rib so as to be integrally formed with each other. Alternatively, the ship may have a single-hull structure without the inner wall 12.

In addition, the interior of the hull, that is, the interior of the inner wall 12, may be divided by one or more bulkheads 14. The bulkhead 14 may be formed of a cofferdam installed in a conventional LNG carrier 1, as known in the art.

Each of the internal spaces divided by the bulkhead 14 may be utilized as a storage tank 10 for storing cryogenic liquid such as LNG.

Here, an inner wall surface of the storage tank 10 is sealed in a liquid-tight manner by a sealing wall. That is, the sealing wall has a structure in which plural metal plates are integrally connected to one another by welding to form a single storage space, whereby the storage tank 10 can store and transport LNG without leakage.

The sealing wall directly contacting ultra-low temperature LNG may have a corrugated portion to cope with temperature change caused by loading/unloading of LNG.

The sealing wall 50 is securely connected to the inner wall 12 or the bulkhead 14 of the ship 1 through a plurality of anchor structures 30. Thus, the sealing wall 50 cannot be moved relative to the hull.

A heat insulating wall is interposed between the sealing wall 50 and the inner wall 12 or the bulkhead 14 to form a heat insulating layer. The heat insulating wall is composed of a corner structure 20 disposed at a corner of the storage tank 10, an anchor structure (not shown) disposed around an anchor member, and a planar structure 40 disposed on a flat portion of the storage tank 10. In other words, the corner structure 100, the anchor structure, and the planar structure 200 are arranged to form a whole heat insulating layer in the storage tank 10. That is, the insulating layer may be entirely provided to the storage tank 10 by the corner structure 20, the anchor structure 30, and the planar structure 40.

Here, the anchor structure 30 includes a rod-shaped anchor member directly connecting and securing the sealing wall to the hull and an insulator disposed around the anchor member.

In addition, the sealing wall 50 is mainly supported by the anchor structure 30, and the corner structure 20 and the planar structure 470 only support the load of LNG applied to the sealing wall 50 and are not directly coupled to the anchor structure 30.

FIG. 2 is a sectional view of a portion of a typical LNG storage tank, as disclosed in Korean Patent No. 499,710.

Referring to FIG. 2, the typical LNG storage tank 10 includes secondary heat insulating walls 22, 32, 42 and primary heat insulating walls 24, 34, 44 sequentially formed on an inner wall 12 or a bulkhead 14 constituting a part of a hull; and secondary sealing walls 23, 33, 43 interposed between the secondary heat insulating walls 22, 32, 42 and the primary heat insulating walls 24, 34, 44. In addition, a primary sealing wall 50 is disposed on the primary insulating walls 24, 34, 44.

The LNG storage tank 10 includes corner structures 20 disposed at inner corners thereof, anchor structures 30 disposed at certain intervals on a bottom surface thereof, and planar structures 40 interposed between the corner structures 20 or the anchor structures 30 to be slidable. Here, the corner structure 20, the anchor structure 30, and the planar structure 40 are preliminarily manufactured as unit modules and then assembled to the storage tank 10. Then, the primary sealing wall 50 is disposed thereon to seal the heat insulating walls in a liquid-tight manner, thereby providing a space for storing LNG inside the primary sealing wall.

As shown in FIG. 2, the corner structure 20, the anchor structure 30, and the planar structure 40 include the primary heat insulating walls 24, 34, 44, the secondary heat insulating walls 22, 32, 42 and the secondary sealing walls 23, 43, respectively, and are collectively referred to as heat insulating wall structures 20, 30, 40.

In the heat insulating wall structures 20, 30, 40, the secondary sealing wall and heat insulating walls of each of the unit modules are bonded together via adhesives so as to be integrally formed with one another. Generally, the secondary heat insulating walls 22, 32, 42 are composed of polyurethane foam, which is an insulating material, and a plate attached under the polyurethane foam. The primary heat insulating walls 24, 34, 44 are composed of polyurethane foam and a plate adhered thereto with adhesives. Further, the primary sealing wall is disposed on the primary heat insulating walls 24, 34, 44 and is welded to the anchor structure 30.

In addition, the secondary heat insulating wall 42 of the planar structure 40 is formed at a lower end thereof with a flange 42*a*, which is larger than the secondary heat insulating wall 42. The flange 42*a* is inserted into a groove formed in a lower end of the anchor structure 30 to be slightly slidable.

In the illustrated example, each of the anchor structures 30 includes an anchor support rod 36, a lower securing member 37, a secondary anchor insulation wall 32 and a primary anchor insulation wall 34, and a secondary sealing wall 33 is interposed between the secondary anchor insulation wall 32 and the primary anchor insulation wall 34. The anchor support rod 36 is connected at one end thereof to the primary sealing wall 50, and is connected at the other end thereof to the inner wall 420 of the hull through the securing member 37.

The primary sealing wall 50 is welded to an upper end of the anchor support rod 36 of the anchor structure 30.

The anchor structure 30 is placed at the connection point between the neighboring planar structures 40 to interconnect the planar structures, and the planar structure 40 is secured to the inner wall 12 of the hull or the bulkhead 14, constituting the storage tank 10. In addition, the securing member 37 of the anchor structure 30 is disposed around the anchor support rod 36.

In the typical LNG storage tank, the heat insulating wall structure is composed of the primary and secondary heat insulating walls and the primary and secondary sealing walls and thus has a complicated structure. In addition, the structure for connecting the secondary sealing wall of the LNG storage tank is complicated and installation of the heat insulating wall is not easy. Further, there is a possibility that sealing reliability of the secondary sealing wall is reduced, causing LNG leakage, since the structure of a connection of the anchor structure or the secondary sealing wall is complicated and installation of the anchor structure or the secondary sealing wall is difficult.

In addition, the typical corner structure 20, which only supports the load of LNG applied to the sealing wall 50 without supporting the sealing wall 50, has a problem in absorption of stress due to thermal deformation of the storage tank caused by loading/unloading of LNG at extremely low temperature or due to deformation of the hull.

In order to solve these problems, storage tanks having a new structure different from that of typical LNG storage tanks have been proposed to reduce boil-off gas (BOG), which is a loss due to vaporization of LNG having a liquid phase at ultra-low temperature, while simplifying the structure of a storage tank and a manufacturing process. Therefore, there is a need for a corner structure having a new structure.

DISCLOSURE

Technical Problem

It is an aspect of the present invention to provide a corner structure of an LNG storage tank, which can simplify structures of a heat insulating wall and a sealing wall and a coupling structure thereof, improve workability, increase sealing reliability, is simple to assemble and manufacture to reduce a construction time of the storage tank, and allows a corner of the storage tank to effectively eliminate mechanical stress generated in the storage tank.

Technical Solution

In accordance with one aspect of the present invention, there is provided a corner structure of an LNG storage tank installed at a corner of the LNG storage tank to support a sealing wall disposed on an inner surface of an LNG storage tank to prevent leakage of LNG. The corner structure includes: a securing member secured to an inner surface of a corner of the storage tank; a movable member supported on the securing member to be linearly movable; a stop member attached to the securing member to prevent the movable member from being separated from the securing member; and a heat insulating member interposed between the sealing wall and a hull, wherein the securing member includes a guide portion formed with a guide groove, the movable member includes a guide projection inserted into the guide groove, and the guide protrusion is movable in the guide groove.

The guide projection may have a smaller length than the guide groove such that the movable member can be supported on the securing member to be movable in a longitudinal direction.

The guide projection may have a smaller width than the guide groove, such that the movable member can be supported on the securing member to be movable in a direction perpendicular to the longitudinal direction.

The stop member may be coupled to the guide portion to prevent the guide protrusion from being separated from the guide groove.

The stop member may include a convex portion inserted into the guide groove and an edge having a larger width than the convex portion, and the guide projection can be prevented from being separated from the guide groove by the edge.

One movable member may be supported by a plurality of securing members.

The securing member of the corner structure may include: a securing portion secured to an inner surface of the storage tank; and a first extension and a second extension secured to the securing portion, and the first extension and the second extension cross each other at right angles without being directly connected to each other.

The securing portion may have a through-hole and the corner structure may be secured to the inner surface of the storage tank by inserting a stud bolt securely mounted on the inner surface of the storage tank into the through-hole and fastening the stud bolt to a nut.

At least one of the first and second extensions may include one side secured to the securing portion and the other side supporting the movable member.

Each of the first and second extensions may have a plurality of openings and connections between the openings, and, when assembled together, the first and second extensions may be arranged to cross each other such that the connections of the first extension pass through the openings of the second extension and the connections of the second extension pass through the openings of the first extension.

One guide portion may be formed with two guide grooves.

The stop member may include two convex portions corresponding to the two guide grooves.

The movable member of the corner structure may be formed with a joint to which the sealing wall is joined.

The joint may include first and second joints having a height difference, and the sealing wall includes a first sealing membrane directly contacting LNG and a second sealing membrane separated from the first sealing membrane by a predetermined distance, wherein the first sealing membrane may be joined to the first joint and the second sealing membrane may be joined to the second joint.

The stop member may be manufactured separately from the securing member and the movable member and may be fastened to the securing member after the movable member is placed on the securing member.

The sealing wall may include a first sealing membrane directly contacting LNG and a second sealing membrane separated from the first sealing membrane by a predetermined distance, and a supporting board may be interposed between the first sealing membrane and the second sealing membrane to maintain a constant distance between the first sealing membrane and the second sealing membrane.

In accordance with another aspect of the present invention, there is provided an LNG storage tank including a corner structure disposed at a corner thereof and supporting a sealing wall for preventing leakage of LNG, wherein the corner structure storage tank includes: a securing member secured to an inner surface of a corner of the storage tank; a movable member supported on the securing member to be linearly movable; a guide groove formed in the securing member; a guide protrusion formed on the movable member to be inserted into the guide groove; a stop member attached to the securing member while adjoining the guide protrusion such that the guide protrusion is movable only in a longitudinal direction or transverse direction of the guide protrusion in the guide groove and is not movable in a height direction of the guide protrusion; and a heat insulating member interposed between the sealing wall and a hull.

Advantageous Effects

As described above, according to the present invention, it is possible to provide a corner structure of an LNG storage tank which can simplify the structures of a heat insulating wall and a sealing wall and the coupling structure thereof, improve workability, increase sealing reliability, is simple to assemble and manufacture to shorten the construction time of the storage tank, and allows a corner of the storage tank to effectively eliminate mechanical stresses generated in the storage tank.

EMBODIMENTS

Hereinafter, exemplary embodiments of the present invention will be described in detail with reference to the accompanying drawings. It should be understood that the present invention may be embodied in different ways and is not limited to the following embodiments.

Figure 1:
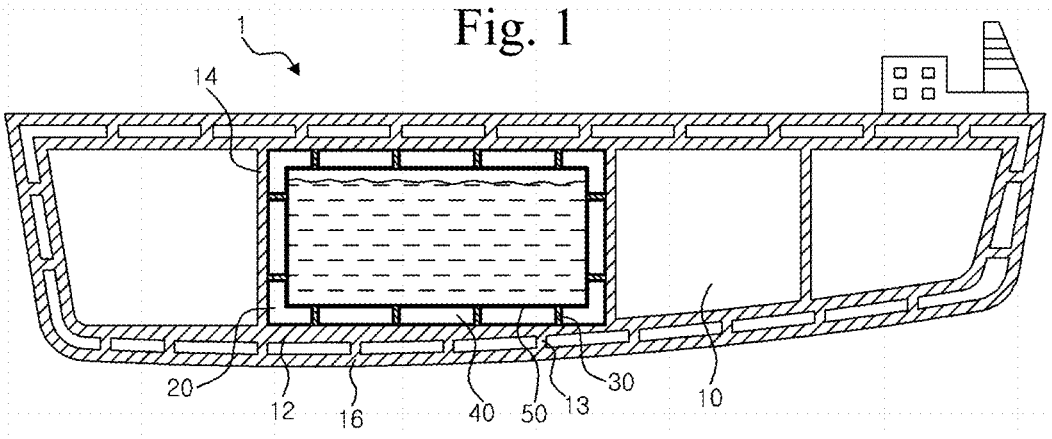
FIG. 1 is a schematic sectional view of a ship equipped with a typical LNG storage tank.

Referring to FIGS. 3 to 6, a corner structure 100 according to an exemplary embodiment of the present invention includes a securing member 110 or 110*a* secured to an inner surface of a storage tank 10 (see FIG. 1), i.e. a surface of a hull structure such as an inner wall 12 (see FIG. 1) and a bulkhead 14 (see FIG. 1); a movable member 130 supported on the securing member 110 and joined to a sealing membrane 51, 52; and a heat insulating member 150 disposed around the securing member 110.

Here, the movable member is linearly movable with respect to the securing member to a slight degree, as described below, upon thermal deformation due to temperature changes caused by loading/unloading of ultra-low temperature LNG or deformation of the hull due to waves or the like.

As shown in FIGS. 4, 5, 9, 10 and 11, the securing member 110 or 110*a* has a cross (+) shape in which a first extension 112 and a second extension 113 cross each other at a right angle. The securing member 110 or 110*a* includes a securing portion 111 secured to the hull (for example, the inner wall 12 or the bulkhead 14) and the first and second extensions 112, 113 secured to the securing portion 111 by welding or the like.

Figure 9:
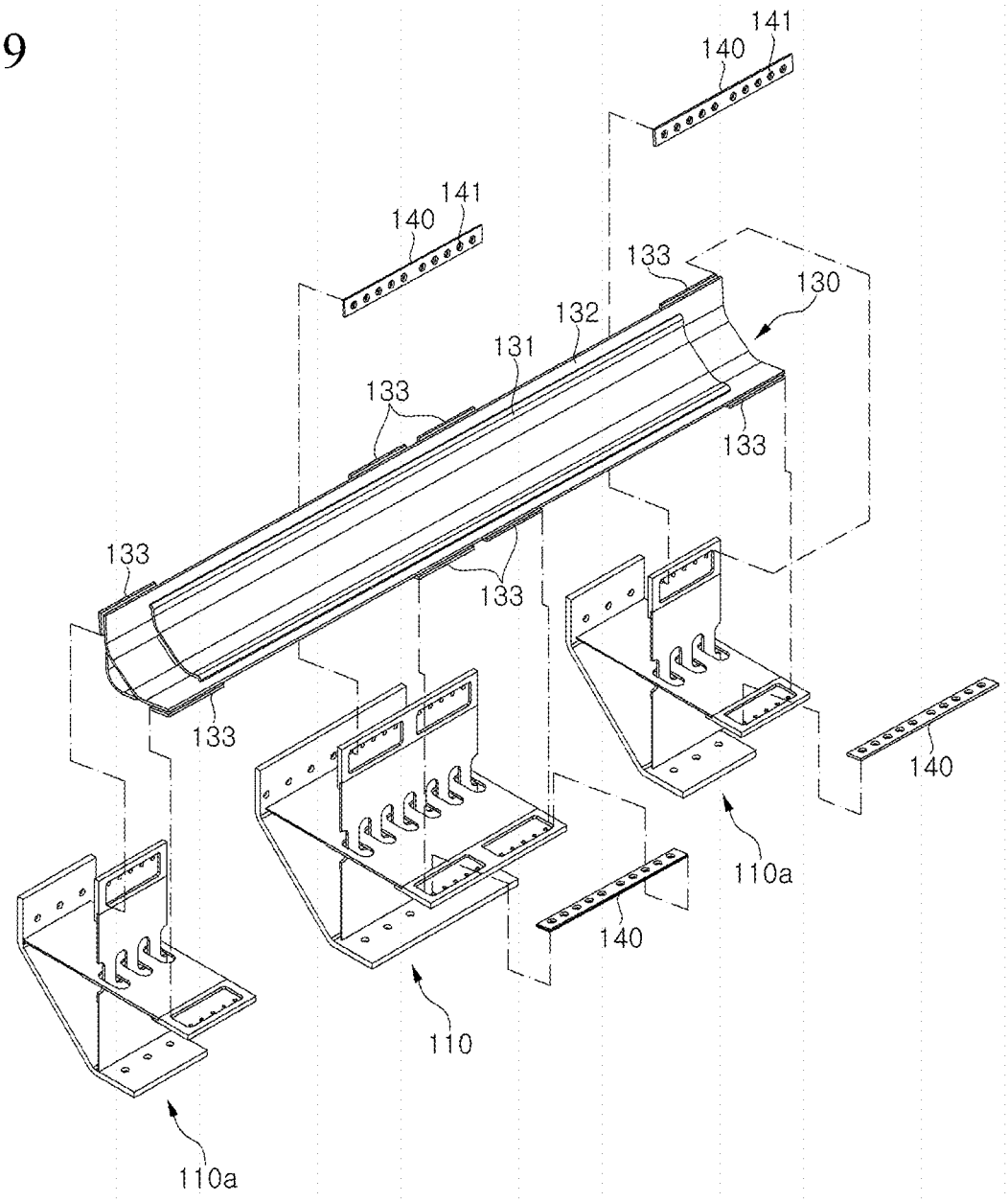
FIG. 9 is an exploded perspective view of a main portion of the corner structure according to the exemplary embodiment of the present invention.

Referring to FIG. 9, a securing member 110 supporting a central portion of the movable member 130 and a securing member 110*a* supporting both ends of the movable member 130 are shown. Since the securing members 110, 110*a* differ only in length, hereinafter, the securing member 110 supporting the central portion of the movable member 130 will be described by way of example without separately distinguishing the securing members 110, 110*a*.

The securing portion 111 includes first and second abutment portions 111*a*, 111*b* directly adjoining the hull and secured by nuts and the like and an inclined portion 111*c* obliquely extending between the first abutment portion 111*a* and the second abutment portion 111*b* when viewed in section. The inclined portion 111*c* may be inclined at an angle of about 45 degrees with respect to the hull.

As described above, one side 112*a* or 113*a* of each of the first and second extensions 112, 113 may be secured to the securing portion 111 and the other side 112*b* or 113*b* of each of the first and second extensions 112, 113 may support the movable member 130. The one side 112*a* of the first extension 112 may be secured to the first abutment portion 111*a* and the one side 113*a* of the second extension 113 may be secured to the second abutment portion 111*b*.

The first extension 112 and the second extension 113 may have substantially the same shape and may be arranged at a right angle to each other when assembled. Each of the first and second extensions 112, 113 have a plurality of openings 112*c* or 113*c* formed in a straight line in the middle portion thereof and connections 112*d* or 113*d* formed between the openings to connect the one side 112*a* or 113*a* to the other side 112*b* or 113*b*.

When assembled through welding, the first extension 112 and the second extension 113 are arranged to cross each other such that the connections 112*d* of the first extension 112 pass through the openings 113*c* of the second extension 113 and the connections 113*d* of the second extension 113 pass through the openings 112*c* of the first extension 112. For intersection of the first extension 112 and the second extension 113, at least one of the first extension 112 and the second extension 113 may be formed by separately forming the one side 112*a* or 113*a* and the other side 112*b* or 113*b*, which are divided with respect to the connections 112*d* or 113*d*, and joining them upon assembly.

Figure 11:
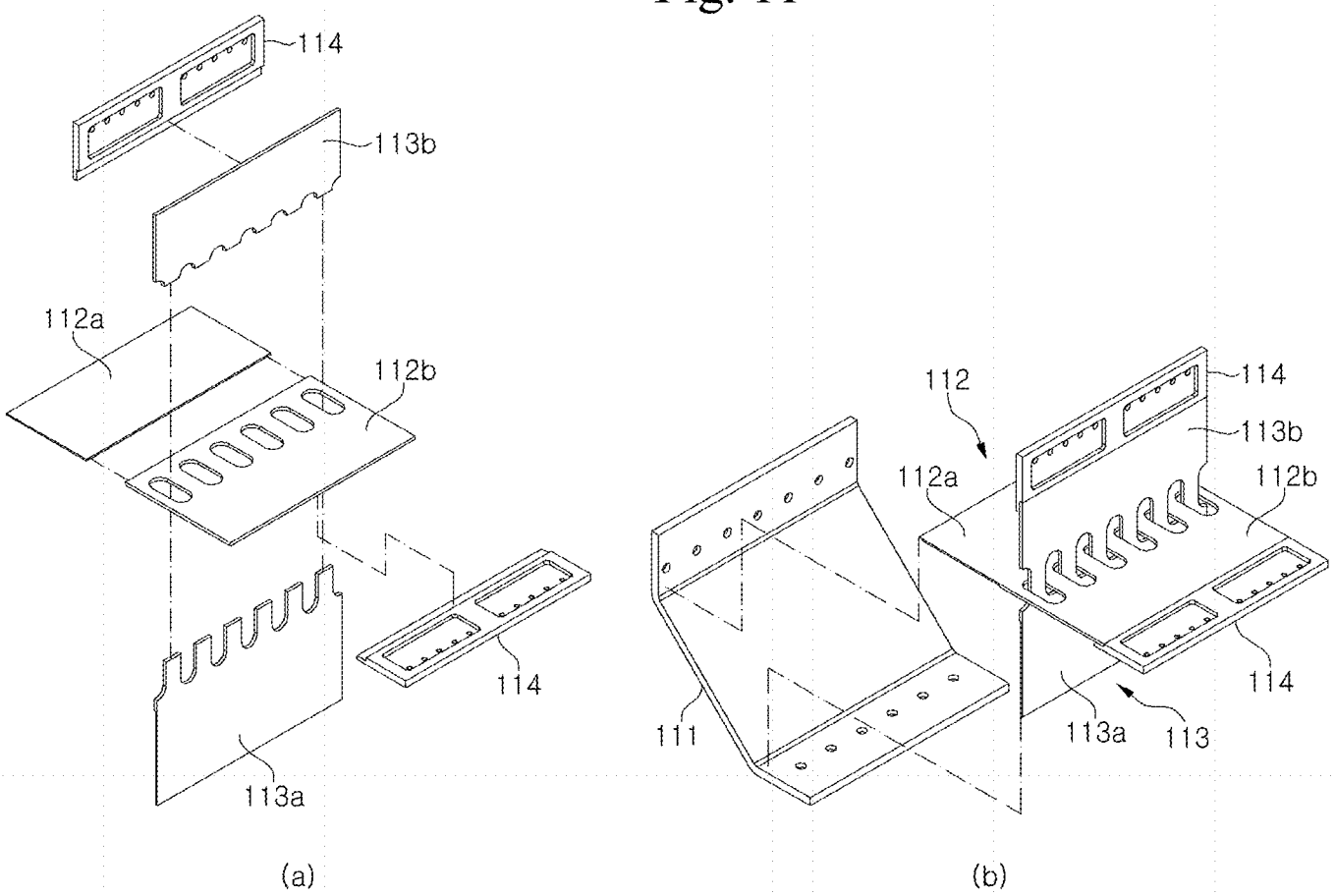
FIG. 11 shows exploded perspective views illustrating a sequence in which the securing member of FIG. 10 is assembled by welding.

As shown in FIG. 11(*a*), one of the first and second extensions, for example, the first extension 112, may be composed of the one side 112*a* having a substantially rectangular plate-like shape and the other side 112*b* having the openings 112*c* and the connections 112*d*. For the other extension, that is, the second extension 113, the one side 113*a* and the other side 113*b*, divided with respect to the connections 113*d*, are separately formed and are then joined together upon assembly. A guide portion 114 may be secured to the other side 112*b* or 113*b* of each of the first and second extensions by welding or the like.

Figure 10:
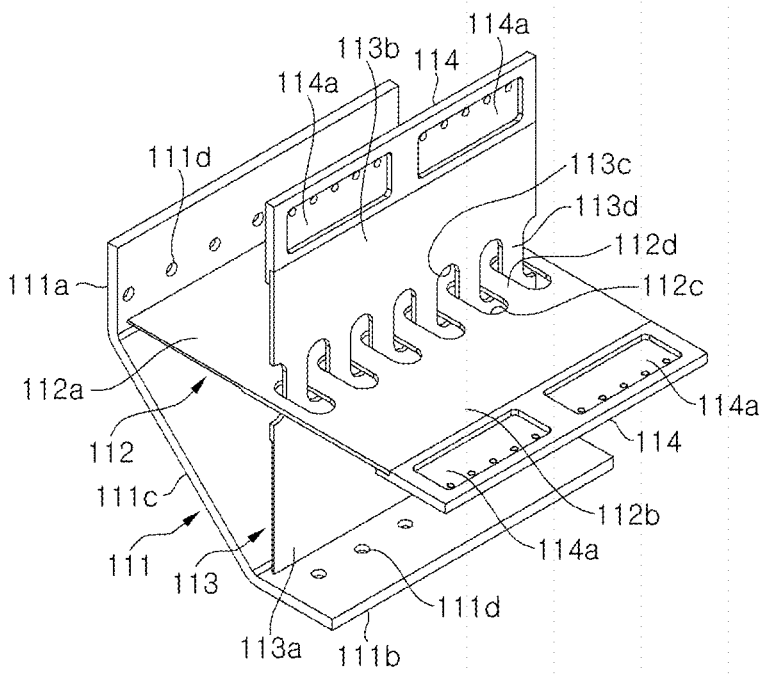
FIG. 10 is a perspective view of a securing member of the corner structure according to the exemplary embodiment of the present invention.

For intersection of the first extension 112 and the second extension 113, first, the connections 113*d* of the second extension are inserted into the opening 112*c* of the first extension 112. Then, the one side 113*a* and the other side 113*b* of the second extension 113 are welded to each other, thereby forming the first and second extensions 112, 113 arranged to cross each other, as shown in FIG. 10.

The one side 112*a*, the other side 112*b*, and the guide portion 114 of the first extension 112 may be welded to one another before assembly.

Then, as shown in FIG. 11(*b*), the first and second extensions 112, 113 assembled together with the respective openings and connections crossing each another are secured to the securing portion 111 by welding or the like, thereby completing the securing member 110 or 110*a*.

If the first and second extensions are directly connected to each other, stress due to external force can be concentrated on a connection therebetween. According to this embodiment, since the first extension 112 and the second extension 113 of the securing member 110 or 110*a* are secured to the securing portion 111 by welding and are not directly coupled to each other, stress concentration is not likely to occur even when external force is applied to the securing member.

The first and second abutment portions 111*a*, 111*b* of the securing portion 111 have a plurality of through-holes 111*d* formed at regular intervals such that a plurality of stud bolts 61 securely mounted on the inner surface of the storage tank 10 can be inserted into the through-holes 111*d* and secured by nuts 62, respectively.

The guide portion 114 formed with a concave guide groove 114*a* for guiding linear movement of the movable member 130 is attached to each of the other sides 112*b*, 113*b* of the first and second extensions 112, 113. In other words, the guide portion 114 is integrally attached to an edge of each of the other sides 112*b*, 113*b* of the first and second extensions 112 by welding or the like. Referring to FIG. 9, two guide grooves 114*a* are formed on the guide portion 114 of the securing member 110 disposed to support the central portion of the movable member 130, whereas one guide groove 114*a* is formed on the guide portion 114 of the securing member 110*a* disposed to support both ends of the movable member 130.

Figure 4:
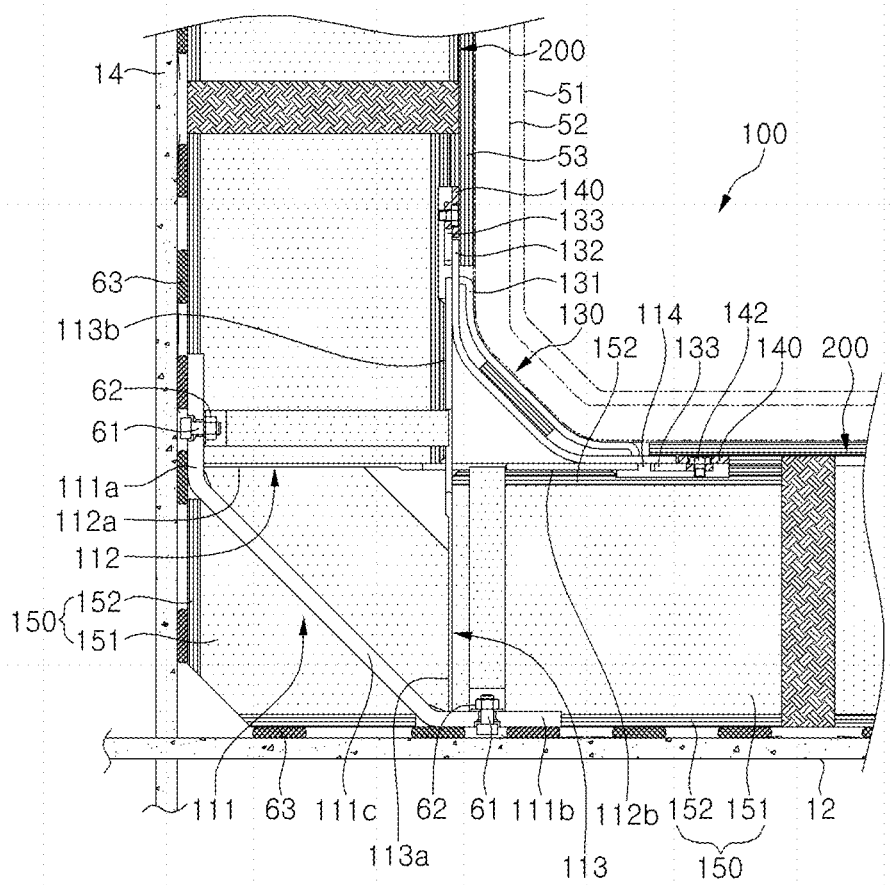
FIG. 4 is a sectional view taken along plane A-A of FIG. 3.
Figure 5:
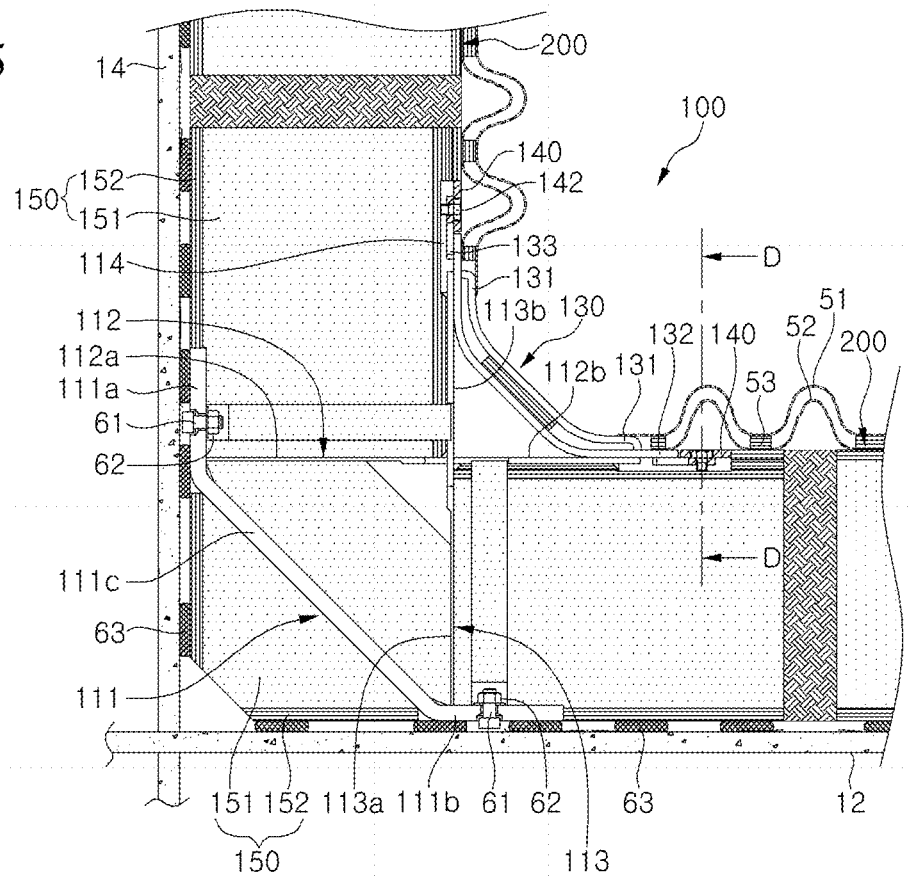
FIG. 5 is a sectional view taken along plane B-B of FIG. 3.
Figure 6:
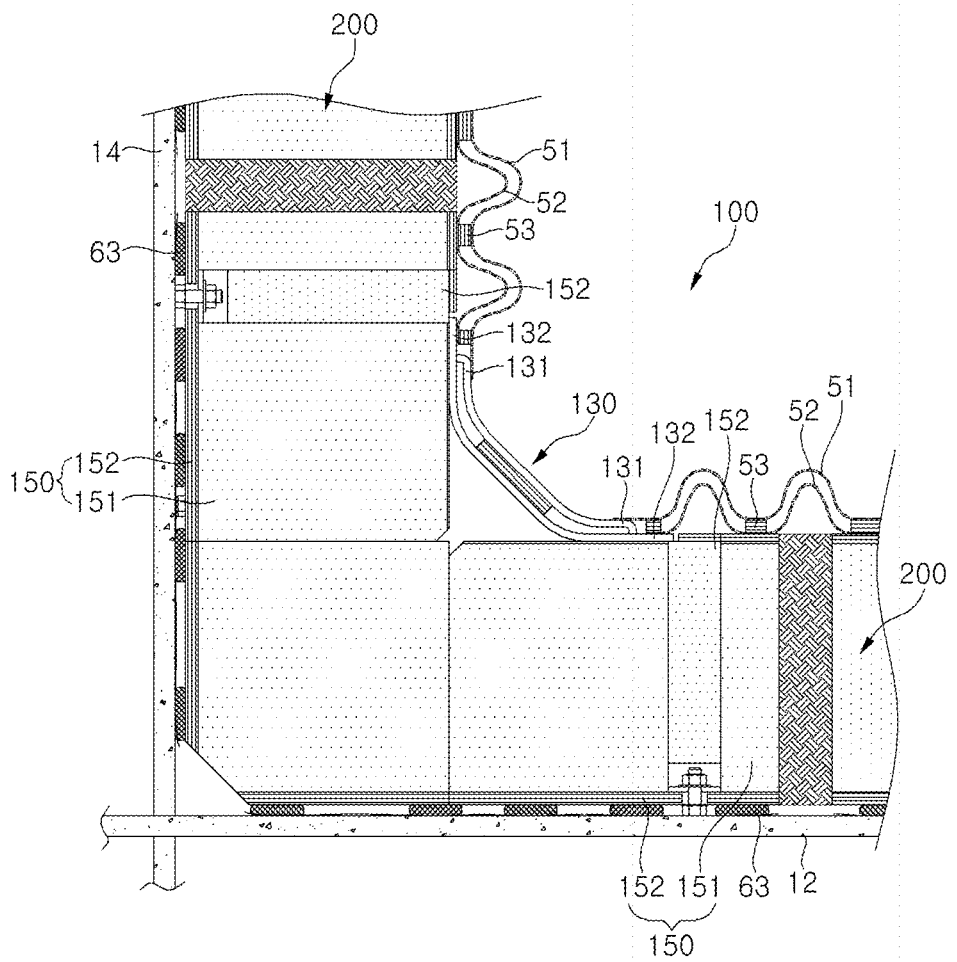
FIG. 6 is a sectional view taken along plane C-C of FIG. 3.

As shown in FIGS. 4 to 6, the movable member 130 has a shape that can be disposed at a corner of the storage tank 10. The sectional shape of the movable member 130 may be similar to that of the securing portion 111 of the securing member 110 as described above. In other words, both edges of the movable member 130 may abut against the first and second extensions 112, 113, and the middle portion of the movable member may be inclined at an angle of about 45 degrees when viewed in section, as shown in FIGS. 4 to 6.

The movable member 130 is formed with two joints, that is, a first joint 131 and a second joint 132, having a predetermined height difference. First and second sealing membranes 51, 52 are securely mounted on the first and second joints 131, 132, respectively, by welding.

Referring to FIG. 9, the movable member 130 is formed with a plurality of guide protrusions 133 so as to be slidably coupled to the securing members 110, 110*a*.

Figure 8:
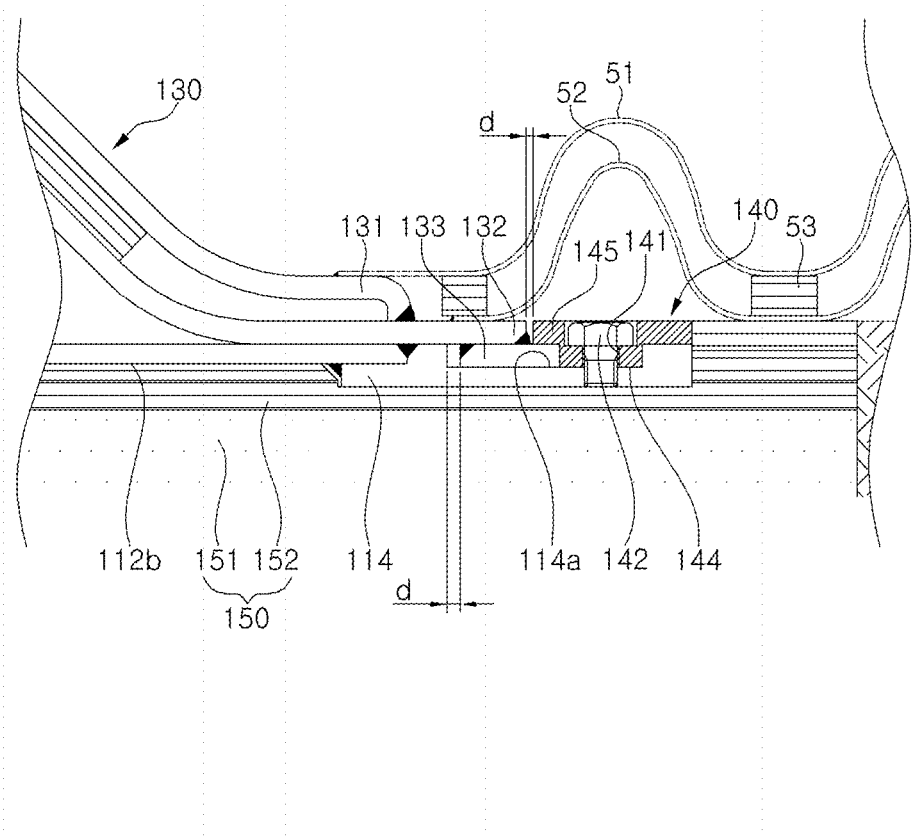
FIG. 8 is an enlarged view of a main portion of FIG. 5.

As shown in FIGS. 8 and 9, the guide protrusion 133 of the movable member 130 is inserted into the guide groove 114*a* to be slidable in the longitudinal direction of the movable member. For this purpose, the guide protrusion 133 of the movable member 130 has a smaller length than the guide groove 114*a*.

A stop member 140 is coupled to the guide portion 114 to prevent the guide protrusion 133 of the movable member 130 from being separated from the guide groove 114*a*. The stop member 140 may be fastened to the guide portion 114 by a fastener 142 such as a bolt. For this purpose, the stop member 140 is formed with a through-hole 141 through which the fastener 142 can pass.

Figure 7:
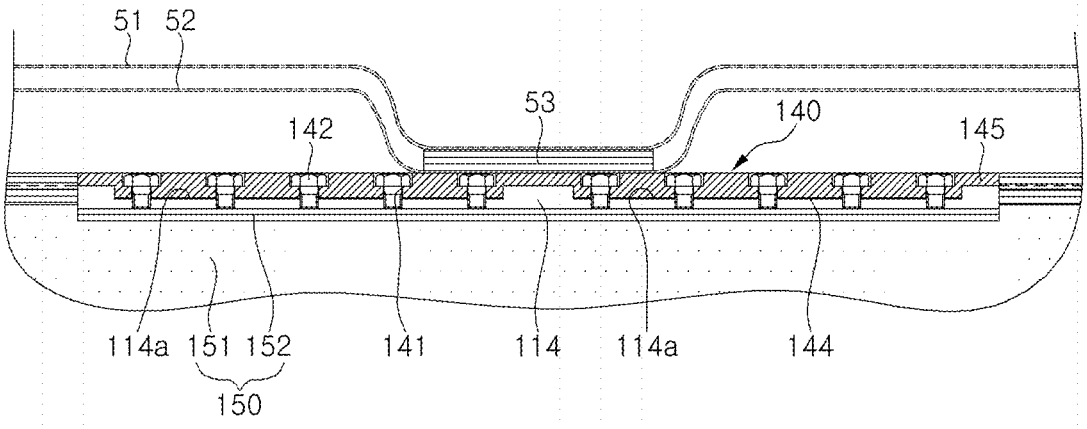
FIG. 7 is a sectional view taken along plane D-D of FIG. 3.

Referring to FIG. 7, one stop member 140 is coupled to two guide grooves 114*a* formed on the guide portion 114 attached to one end of each of the other sides 112*b*, 113*b* of the first and second extensions 112, 113. One stop member 140 is formed with two convex portions 144. The distance between two convex portions 144 is the same as the distance between the two guide grooves 114*a*. When two corner assemblies are disposed adjacent to each other in the longitudinal direction, the securing members 110*a* supporting both ends of the respective movable members 130 of the corner assemblies are placed adjacent to each other. Here, the distance between the respective guide grooves 114*a* formed on the guide portions 114 of the securing members 110*a*, which are included in the different corner assemblies and are disposed adjacent to each other, is the same as the distance between two guide grooves 114*a* formed on the guide portion 114 of the securing member 110, which supports the central portion of the movable member 130.

Referring to FIG. 8, since the width of the convex portion 144 is smaller than the entire width of the stop member 140, an edge 145 of the stop member 140 protrudes outward. The guide protrusion 133 of the movable member 130 is retained in the guide groove 114*a* by the edge 145 of the stop member 140. That is, the edge 145 abuts against the guide projection 133 to prevent the guide projection 133 from being separated from the guide groove 114*a* in a vertical direction.

As shown in FIG. 8, since the width of the guide projection 133 is smaller than the width of the guide groove 114*a* with the stop member 140 coupled thereto, a gap d can exist between the inner wall surface of the guide groove 114*a* and the guide projection 133. In addition, a gap d can also exist between the second joint 132 of the guide member 130 and the edge 145 of the stop member 140. Accordingly, the guide projection 133 can be moved within the guide groove 114*a* by a distance allowed by the gap d in the lateral direction of the drawing, as viewed in FIG. 8.

As described above, the movable member 130 is prevented from being separated from the securing member 110 or 110*a* by the stop member 140 and may be mounted such that the guide projection 133 is linearly movable in the guide groove 114*a* in the longitudinal direction of the movable member 130 or in the vertical direction thereof. Accordingly, it is possible to absorb relative displacement, which can occur between the movable member 130 and the securing member 110 or 110*a* due to external force such as thermal deformation.

As shown in FIGS. 7 to 9, the stop member 140 is fabricated separately from the movable member 130 and is preferably attached at a position where the guide groove 114*a* of the securing member 110 or 110*a* is formed using a bolt or the like after placing the movable member 130 on the securing member 110 or 110*a*. The reason for this is that, in the case that the stop member 140 is integrally formed with the securing members 110, 110*a*, when the movable member 130 is placed on the securing members 110, 110*a*, the guide protrusions 133 of the movable member 130 interfere with the stop member 140 and the guide protrusion 133 cannot be inserted into the guide groove 114*a*.

The movable member 130 is supported on three securing members securely mounted at regular intervals along a corner of the storage tank 10, that is, one securing member 110 located at the center and two securing members 110*a* located at both ends.

As shown in FIGS. 4 to 6, each of the securing members 110, 110*a* may be secured to the inner surface of the storage tank 10 by inserting a plurality of stud bolts 61 preliminarily secured to the inner surface of the storage tank 10 into the through-hole 111*d* formed through the securing portion 111 of the securing members 110, 110*a* and fastening the bolts to the nuts 62.

In addition, the movable member 130 may be movably mounted on the securing members 110, 110*a* by inserting the guide protrusions 133 into the guide grooves 114*a* of the securing members 110, 110*a* and coupling the stop member 140 to the guide grooves 114*a*.

Here, the movable member 130 is not fixedly connected to the securing members 110, 110*a*. In other words, when the movable member 130 expands or contracts in the longitudinal direction thereof due to thermal deformation, or when the storage tank is deformed by external force, relative displacement between the guide portion 114 of the securing member 110 or 110*a* and the guide projection 133 of the movable member 130 is allowed, thereby allowing the movable member 130 to be linearly moved with respect to the securing member.

As described above, the inner wall surface of the storage tank 10 is sealed in a liquid-tight manner by the first and second sealing membranes 51, 52. Each of the first and second sealing membranes 51, 52 has a structure in which plural metal plates are integrally connected to one another by welding to form a single storage space, whereby the storage tank 10 can store and transport LNG without leakage.

Each of the first sealing membrane 51 directly contacting LNG at ultra-low temperature and the second sealing membrane 52 spaced apart from the first sealing membrane 51 may have a corrugated portion to cope with temperature change caused by loading/unloading of the LNG.

The first and second sealing membranes 51, 52 are connected to the hull of a ship 1, that is, the inner wall 12 or the bulkhead 14 through a plurality of corner structures 100 and a plurality of anchor structures (not shown).

A heat insulating member 150 is interposed between the second sealing membrane 52 and the inner wall 12 or the bulkhead 14 to form a heat insulating layer. The heat insulating member 150 may also be included in the corner structure 100 disposed at a corner of the storage tank 10, the anchor structure (not shown) disposed around the anchor member, and the planar structure 200 disposed on a flat portion of the storage tank 10. In other words, a heat insulating layer is entirely provided to the storage tank 10 by arranging the corner structure 100, the anchor structure, and the planar structure 200.

Each of the corner structure 100, the anchor structure, and the planar structure 200 arranged in the storage tank 10 may be manufactured as a module in a separate place and then transferred to the storage tank 10 and assembled. Such modularization can improve workability in manufacture of the LNG storage tank.

For the corner structure 100, after a corner structure module having a length corresponding to the length of the movable member 130 is manufactured outside the storage tank, that is, at a factory or the like, the modular corner structure may be moved into the interior of the storage tank and mounted on a corner of the storage tank. When the corner structure 100 is preliminarily manufactured as a module having a length corresponding to the length of the movable member, it is possible to eliminate the leveling problem that can occur when the securing member is installed in the storage tank and then the movable member is separately mounted on the securing member.

The first and second sealing membranes 51, 52 are supported by the corner structure 100 and the anchor structure, and the planar structure 200 supports only the load of LNG applied to the first and second sealing membranes 51, 52. In addition, the planar structure 200 is not directly coupled to the corner structure 100 or the anchor structure.

Here, the corner structure 100 includes the securing member 110 and the movable member 130, which directly connect the first and second sealing membranes 51, 52 to the hull, and the heat insulating member 150 formed to fill an empty space around the securing member 110.

The heat insulating member 150 may be formed of an insulator 151 such as polyurethane foam or reinforced polyurethane foam. In addition, plywood 152 may be attached to upper and/or lower portions of the insulator. Although the heat insulating member 150 included in the corner structure 100 is shown as having a structure in which the plywood 152 is attached to the upper and lower portions of the insulator in FIGS. 4 to 6, it should be understood that the present invention is not limited thereto.

The corner structure 100 is secured to the inner surface of the storage tank 10 (for example, the inner wall 12 of the hull or the bulkhead 14) through the securing portion 112 of the securing member 110 of the corner structure 100.

In addition, a horizontal member 63 for leveling may be interposed between the plywood 152 attached to the lower portion of the heat insulating member 151 and the inner surface of the storage tank 10, as needed. Further, a washer may be interposed between the upper surface of the securing portion 112 and the nut 62 fastened to the stud bolt 61, as is well known in the art.

Furthermore, as described above, the movable member 130 of the corner structure is formed with the first joint 131 and the second joint 132 having a predetermined height difference therebetween. The first sealing membrane 51 and the second sealing membrane 52 are welded to the first joint 131 and the second joint 132, respectively.

As shown in FIGS. 4 to 6, the first sealing membrane 51 and the second sealing membrane 52 are separated from each other by a predetermined distance. The distance is preferably equal to the height difference between the first joint 131 and the second joint 132 of the corner structure 100.

In addition, a supporting board 53 having a predetermined thickness is interposed between the first sealing membrane 51 and the second sealing membrane 52 such that the distance between the first sealing membrane 51 and the second sealing membrane 52 can be kept constant.

The support board 53 may be interposed between portions of the first and second sealing membranes 51, 52 arranged in parallel to each other. That is, the support board 53 may be partially or completely interposed between the remaining portions of the first and second sealing films except for the corrugation.

As the support board 53, plywood having a predetermined thickness may be used alone, polyurethane foam (or reinforced polyurethane foam) having a predetermined thickness may be used alone, or plywood attached to polyurethane (or reinforced polyurethane foam) may be used.

Figure 2:
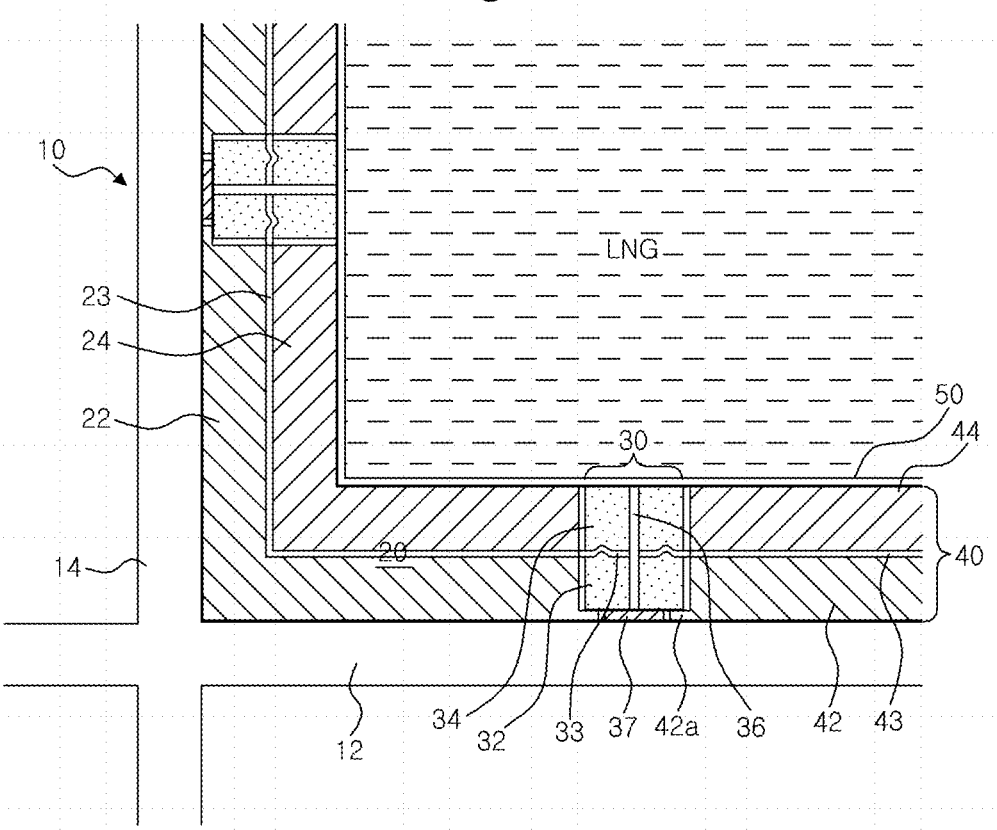
Prior Art Fig. 2
FIG. 2 is a sectional view of a portion of a typical LNG storage tank.
Figure 3:
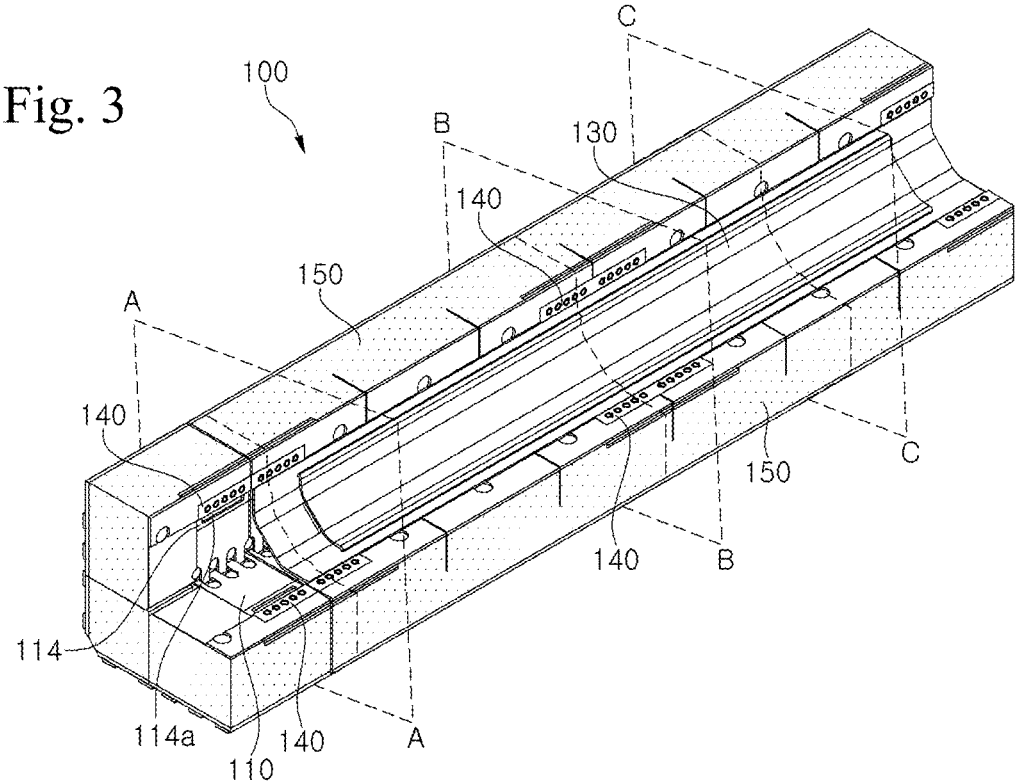
FIG. 3 is a perspective view of a corner structure according to an exemplary embodiment of the present invention.

As described above, according to the present invention, the first sealing membrane 51 and the second sealing membrane 52 are separated from each other and no insulator is interposed therebetween except for the support board 53. As described in FIG. 2, conventional heat insulating wall structures include a primary heat insulating wall interposed between a primary sealing membrane directly contacting LNG and a secondary sealing membrane and thus require a complicated structure for supporting the primary sealing membrane by the secondary sealing membrane through the primary insulating wall. In contrast, the corner structure 100 according to the present invention does not include a separate insulator interposed between the first and second sealing membranes 51, 52, whereby the first and second sealing portions 51, 52 can be relatively easily supported by the first and second joints 131, 132 of the movable member 130.

In addition, according to the present invention, since the first sealing membrane 51 and the second sealing membrane 52 are separated from each other, friction does not occur between the first and second sealing membranes 51, 52 even when the storage tank is deformed due to deformation of the hull caused by external force such as waves, and, even when shock is applied to one of the sealing membranes, damage can be prevented from directly propagating to the other sealing membrane.

Although sealing of the storage tank is described as being achieved through a dual structure of the first sealing membrane 51 and the second sealing membrane 52, sealing of the storage tank can also be achieved through a multilayer structure of three or more sealing membranes.

As described above, according to the present invention, the securing members 110, 110*a* can be secured to the hull by inserting the plurality of stud bolts 61 secured to the inner surface of the storage tank into the plurality of through-holes 111*d* formed through the securing portions 111 of the securing members 110, 110*a* and fastening the bolts to the respective nuts 62. In addition, the movable member 130, to which the sealing membranes 51, 52 are joined, is connected to the securing members 110, 110*a* to be linearly movable with respect to the securing members to a slight degree by the guide groove 114*a* and the guide protrusion 133, whereby the sealing membranes 51, 52 can be supported with respect to the hull.

According to the present invention, since coupling between the securing members 110, 110*a* constituting the corner structure 100 and the inner surface of the storage tank is continuously achieved at plural places and the movable member 130 is linearly movable with respect to the securing members 110, 110*a*, it is possible to reliably absorb stress generated due to thermal deformation caused by loading/unloading of LNG or due to deformation of the hull caused by external force such as waves.

Although the securing member is described as being secured to the inner surface of the hull through mechanical coupling members such as bolts and nuts in the above embodiments, it should be understood that the securing portion of the securing member may be welded directly to the inner surface of the hull.

In addition, the corner structure may be manufactured as a module at a separate place and may be transported to the storage tank of the ship for arrangement therein before assembly.

Further, although the sealing membrane is described as being formed of, for example, corrugated stainless steel for GTT Mark-III-type tanks in the above embodiments, it should be understood that the sealing membrane may be formed of Invar steel for GTT No. 96-type tanks.

Furthermore, the present invention is applicable not only to an LNG storage tank installed inside a hull of a ship, but also to an LNG storage tank installed on the land.

Although some embodiments have been described herein with reference to the accompanying drawings, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

The invention claimed is:

1. A corner structure of an LNG storage tank installed at a corner of the LNG storage tank comprising a sealing wall, the corner structure comprising:

a securing member secured to a hull of a ship;

a movable member supported on the securing member to be linearly movable;

a stop member attached to the securing member to prevent the movable member from being separated from the securing member; and a heat insulating member interposed between the sealing wall and the hull, wherein the securing member comprises a guide groove, the movable member comprises a guide projection inserted into the guide groove, and the guide projection is movable in the guide groove, wherein the guide projection has a smaller length than the guide groove such that the movable member is supported on the securing member to be movable in a longitudinal direction, wherein the guide projection has a smaller width than the guide groove such that the movable member is supported on the securing member to be movable in a direction perpendicular to the longitudinal direction.

2. The corner structure according to claim 1, wherein the guide groove is formed at an end portion of the securing member, wherein the stop member is coupled to the end portion to prevent the guide projection from being separated from the guide groove.

3. The corner structure according to claim 1, wherein the stop member comprises a convex portion inserted into the guide groove and an edge having a larger width than the convex portion, and the guide projection is prevented from being separated from the guide groove by the edge.

4. The corner structure according to claim 1, wherein one movable member is supported by a plurality of securing members.

5. The corner structure according to claim 1, wherein the securing member of the corner structure comprises: a securing portion secured to the hull; and a first extension and a second extension secured to the securing portion, the first extension and the second extension crossing each other at a right angle without being directly connected to each other.

6. The corner structure according to claim 5, wherein the securing portion has a through-hole and the corner structure is secured to the hull by inserting a stud bolt securely mounted on the hull into the through-hole and fastening the stud bolt to a nut.

7. The corner structure according to claim 5, wherein at least one of the first and second extensions comprises one side secured to the securing portion and the other side supporting the movable member.

8. The corner structure according to claim 7, wherein each of the first and second extensions has a plurality of openings and connections between the openings, and, when assembled together, the first and second extensions are arranged to cross each other such that the connections of the first extension pass through the openings of the second extension and the connections of the second extension pass through the openings of the first extension.

9. The corner structure according to claim 1, wherein the securing member comprises an end portion that comprises two guide grooves.

10. The corner structure according to claim 9, wherein the stop member comprises two convex portions corresponding to the two guide grooves.

11. The corner structure according to claim 1, wherein the movable member of the corner structure is formed with a joint to which the sealing wall is joined.

12. The corner structure according to claim 11, wherein the joint comprises first and second joints having a height difference therebetween; and the sealing wall comprises a first sealing membrane directly contacting LNG and a second sealing membrane separated from the first sealing membrane by a predetermined distance, the first sealing membrane being joined to the first joint, the second sealing membrane being joined to the second joint.

13. The corner structure according to claim 1, wherein the stop member is manufactured separately from the securing member and the movable member and is fastened to the securing member after the movable member is placed on the securing member.

14. The corner structure according to claim 1, wherein the sealing wall comprises a first sealing membrane directly contacting LNG and a second sealing membrane separated from the first sealing membrane by a predetermined distance, and a supporting board is interposed between the first sealing membrane and the second sealing membrane to maintain a constant distance between the first sealing membrane and the second sealing membrane.

15. An LNG storage tank including a corner structure disposed at a corner thereof and a sealing wall, wherein the corner structure storage tank comprises:

a securing member secured to a hull of a ship;

a movable member supported on the securing member to be linearly movable;

a guide groove formed on the securing member;

a guide protrusion formed on the movable member to be inserted into the guide groove;

a stop member attached to the securing member while adjoining the guide protrusion such that the guide protrusion is movable only in a longitudinal direction or transverse direction of the guide protrusion in the guide groove and is not movable in a height direction of the guide protrusion; and a heat insulating member interposed between the sealing wall and the hull, wherein the guide protrusion has a smaller length than the guide groove such that the movable member is supported on the securing member to be movable in a longitudinal direction, wherein the guide protrusion has a smaller width than the guide groove such that the movable member is supported on the securing member to be movable in a direction perpendicular to the longitudinal direction.

* * * * *